United States Patent [19]

Neff

[11] Patent Number: 5,074,356

[45] Date of Patent: Dec. 24, 1991

[54] MILLING TOOL AND COMBINED STABILIZER

[75] Inventor: Michael C. Neff, Aberdeen, Scotland

[73] Assignee: Smith International, Inc., Houston, Tex.

[21] Appl. No.: 506,866

[22] Filed: Apr. 9, 1990

[30] Foreign Application Priority Data

Apr. 10, 1989 [GB] United Kingdom ..... 8908014

[51] Int. Cl.[5] ..... E21B 29/00; B23P 6/00; B26D 1/36

[52] U.S. Cl. ..... 166/55.7; 166/241; 175/325; 175/406; 175/408; 407/2; 407/34; 408/201

[58] Field of Search ..... 175/406, 408, 325; 166/55, 55.6, 55.7, 242, 241; 299/89, 90; 407/2, 34, 59; 408/201; 409/144, 174

[56] References Cited

U.S. PATENT DOCUMENTS

| | | | |
|---|---|---|---|
| 2,846,193 | 8/1958 | Chadderdan | 166/55.7 |
| 3,110,084 | 11/1963 | Kinzbach | 408/201 |
| 3,114,416 | 12/1963 | Kammerer | 175/406 |
| 3,147,536 | 9/1964 | Lamphere | 175/406 |
| 3,360,840 | 1/1968 | Kammerer, Jr. | 408/201 |
| 4,549,613 | 10/1985 | Case | 175/406 |
| 4,717,290 | 1/1988 | Reynolds et al. | 407/59 |
| 4,844,179 | 7/1989 | Forrest et al. | 175/325 |

*Primary Examiner*—Bruce M. Kisliuk
*Attorney, Agent, or Firm*—Ladas & Parry

[57] ABSTRACT

A milling tool (3-5; 51-53) in combination with a stabilizer therefor has a milling tool with a body (51) with a plurality of radially extending and circumferential blades (3) diposed about the body. The lower portion of the body (51) has a portion (57) upon which is located a stabilizer (70), the stabilizer comprising a sleeve (71) about which are disposed a plurality of helically disposed fins (75). The sleeve (71) has an internal screw thread (73) for mating with an external screw thread (55) on the body (51).

By providing a single milling tool on site and a plurality of separate pilot stabilizers so stabilizer sleeves can be quickly and easily secured to the milling tool thereby eliminating the necessity of cutting the fins to the required radial height when on site.

10 Claims, 3 Drawing Sheets

MILLING TOOL AND COMBINED STABILIZER

BACKGROUND OF THE INVENTION

1. Field of the Invention

This invention relates to a milling tool combined with a stabiliser therefore, the milling tool being adapted for milling tubular members especially down hole.

2. Description of the Related Art

It is known to provide a milling tool in a drilling string with a stabiliser but the stabiliser tends, in such a configuration, to be too far displaced from the milling tool.

A known combined milling tool and stabiliser is shown in FIGS. 1 and 2 in which FIG. 1 is a side view of a casing milling tool combined with a stabiliser and FIG. 2 is a cross-section along double arrow headed lines A—A.

In the FIGS. 1 and 2 a casing milling tool has a tubular body 1 having a bore 2 therethrough for circulation of mud and six equi-circumferentially radial blades 3 located about the exterior surface of the body 1. Each of the blades 3 is secured, for example by welding, to the body and each of the blades has a leading face 4, that is, facing forwardly in the intended direction of rotation, and a radially outer edge 5 which are coated with crushed tungsten carbide particles randomly dispersed in a bed of brazing material. Crushed tungsten carbide 6 is also provided on a trailing, radially outer, corner 6 of each blade. The outer edge 5 typically has a 5° angle 7 and a 10° attack angle 8. Interspaced between alternate blades 3, are optionally provided stabilising fins 9 each of which has a radially outer edge coated with crushed tungsten carbide.

The pilot stabiliser section 10 is formed by four equi-circumferentially spaced fins 11 each of which are helically formed and located about approximately 90° of the outer circumference of the body 1. Each of the fins 11 is secured, for example, by welding to the body 1 and each of the radially outer edges 12 of the fins 11 is coated with crushed tungsten carbide 15.

It will be seen from FIG. 1 that the pilot section 10 is integrally formed with the section formed by the casing milling tool and both milling tool and pilot stabiliser section 10 are integrally secured to the body 1. A lower, in use, portion 13 of the body 1 has an internal screw thread thereon for securement to other drilling string members and the upper, in use, end of the body 1 has an internal screw thread 14 for securing the body 1 to a drilling string.

Referring now to FIG. 3 which shows a vertical cross-section through a tubular member pipe casing, an outer casing 20 supports an inner casing 21 which is to be milled with there being a casing coupling 22 at an upper end of the casing 21. The space between the casings 20 and 21 is normally filled with cement 23 and, as often occurs, the casing 21 having a longitudinal axis 24 is offset from the longitudinal axis 25 of the casing 20. In FIG. 3 it will be seen that the mill blades 3 are abutting the inside circumference of the casing 20 on the right hand side (as shown in FIG. 3) and the pilot stabiliser 10 is abutting the left hand side of the inner circumference of the casing 21 and the longitudinal axis 26 of the body 1 is offset from both axes 24 and 25.

Thus, it will be appreciated that the radial height of the fins of the pilot stabiliser will need to be varied in dependence upon the offset of casing 21 within casing 22. Hitherto, it has been necessary to either take a number of milling tools each, as shown in FIGS. 1 and 2 and each with different pilot stabiliser fin radial heights onto a drilling site, or, more usually to take a single milling tool, as shown in FIGS. 1 and 2 and to oxyacetylene cut the fins to the required height when on site. It was then necessary to redress and grind the pilot stabiliser and it very often occurred that the fins would crack due to frequent welding so that the life of the tool was greatly reduced.

The present invention seeks to overcame the foregoing disadvantages whereby time on site is substantially reduced and the need to have a large inventory of casing mills with various outside diameter stabilisations is avoided. It is accordingly an object of this invention to provide an improved combination milling tool and stabiliser therefor.

SUMMARY OF THE INVENTION

According to this invention there is provided a milling tool in combination with a stabiliser therefor, said milling tool and said stabiliser both having a fixed outside diameter, said milling tool being adapted for milling tubular members and said stabiliser being adapted to stabilise said milling tool in said tubular member, said milling tool comprising a body having a longitudinal axis and a plurality of radially extending and circumferentially disposed blades about said body, characterised by said stabiliser having an axial internal bore located entirely around a lower, in use, portion of said body, said stabiliser being releasably connected to said milling tool.

Normally the fixed outside diameter of the milling tool is larger than the fixed outside diameter of the stabiliser. Advantageously the stabiliser is a taper mill.

Preferably, the body is releasably connected to the taper mill by a screw thread which is advantageously a tapered screw thread.

In a preferred embodiment an external tapered screw thread is provided on the circumference of said body and a cooperating internally tapered screw thread is provided in the bore of said stabiliser.

Preferably said blades have narrow width in the circumferential direction in relation to the spacing between adjacent blades.

Advantageously, the stabiliser comprises a sleeve having a plurality of fins equi-circumferentially spaced thereabout for contacting and providing stabilisation with the inner circumference of the tubular member to be milled. The fins are, preferably, helically disposed about said sleeve and each fin conveniently extends about approximately 120° of said sleeve.

Conveniently, an axially lower, in use, portion of each fin has a taper thereon and each of the fins has a wear resistant material such as tungsten carbide provided on the radially outer part thereof.

Preferably, the body member has a portion on the side of the screw thread remote from the milling blades which locates within the internal bore of the sleeve for providing additional support therefor.

Advantageously, an axially lower, in use, portion of each fin has a taper thereon, for example, 45°. Preferably, each of the fins has a wear resistant material such as tungsten carbide provided on the radially outer part thereof.

The milling tool blades may be provided with a wear resistant material on a leading, in use, face thereof which wear resistant material may be, for example, tungsten carbide inserts as disclosed in U.S. Pat. No. 4710074 or crushed tungsten carbide particles randomly disposed in a bed of brazing alloy.

The subject invention has the advantage that a single milling tool can be taken to site with a plurality of stabiliser sections which can be quickly and easily threadably secured to the milling tool.

BRIEF DESCRIPTION OF THE DRAWINGS

The invention will now be described, by way of example, with reference to the accompanying drawings in which.

In the drawings like reference numerals denote like parts.

DESCRIPTION OF THE PREFERRED EMBODIMENT

Figure 2:
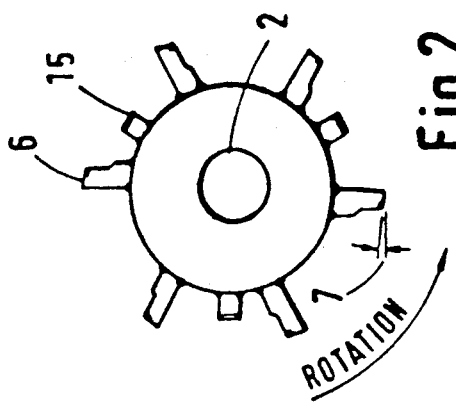
Fig.2 PRIOR ART
FIGS. 1 and 2 show mutually orthogonal views of a prior art casing milling tool and stabiliser.
Figure 1:
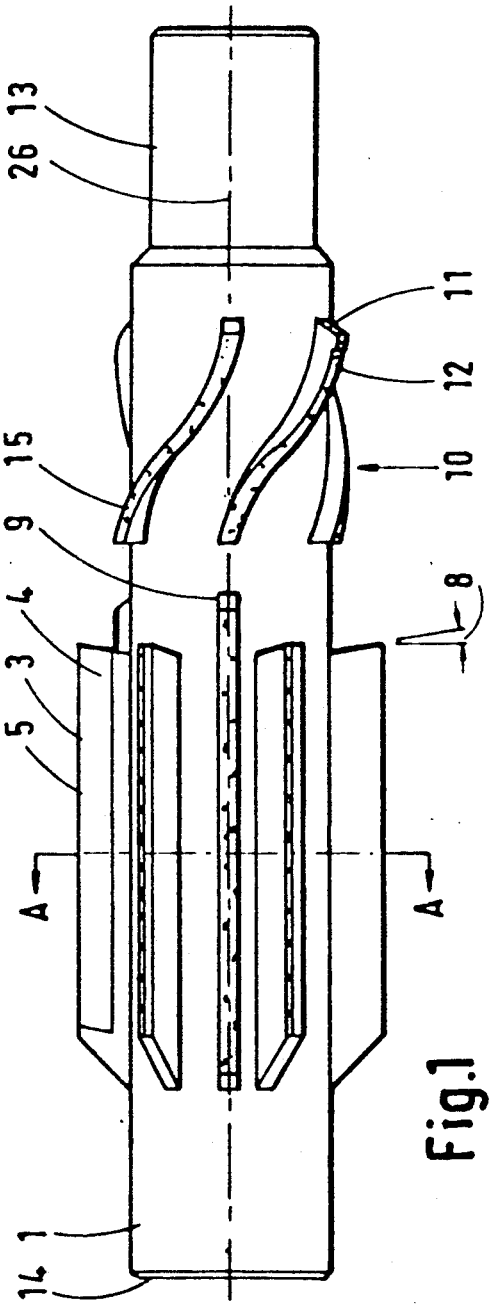
Fig.1 PRIOR ART
Figure 3:
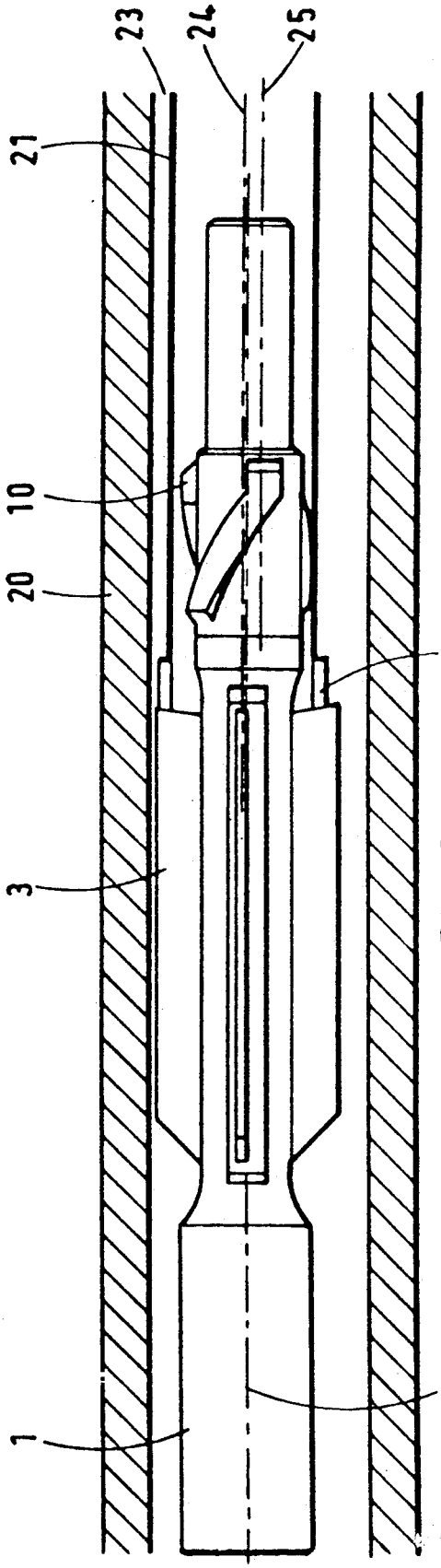
Fig.3 PRIOR ART
FIG. 3 shows a vertical cross-section through a tubular pipe casing in which the combination of FIGS. 1 and 2 is used.
Figure 4:
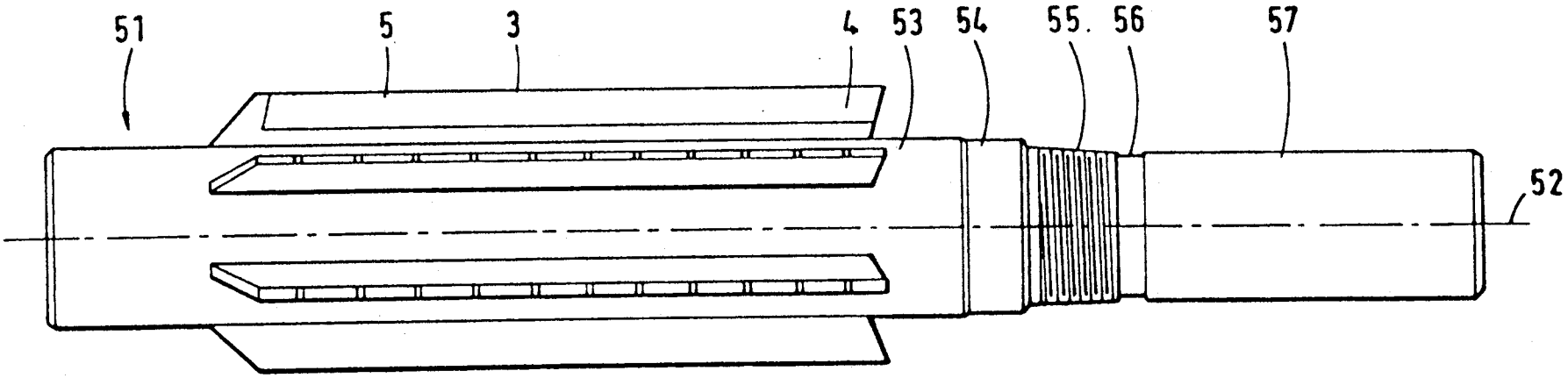
FIG. 4 shows a side view of a milling tool for use in the combination of this invention.
Figure 8:
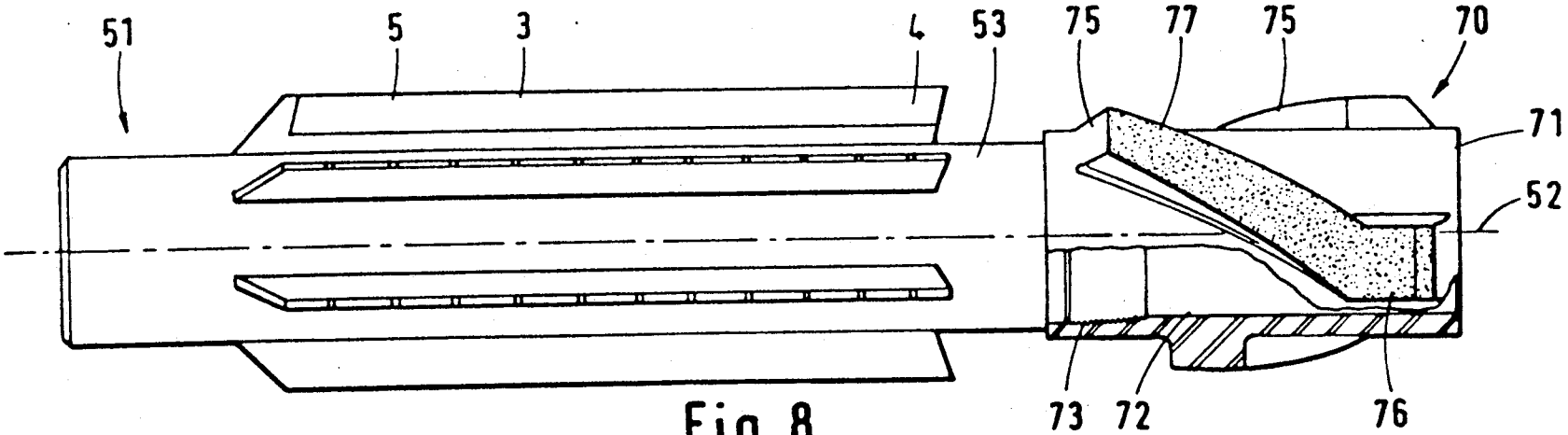
FIG. 8 shows a partially sectioned side view of a combined milling tool and stabiliser in accordance with this invention.
Figure 5:
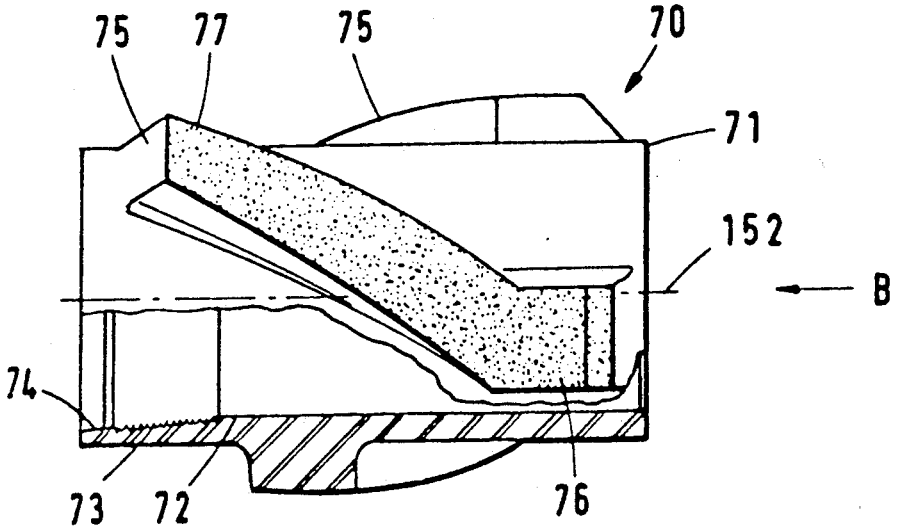
FIG. 5 shows a partially cross-sectioned side view of a pilot stabiliser mill for use in the combination of this invention.
Figure 6:
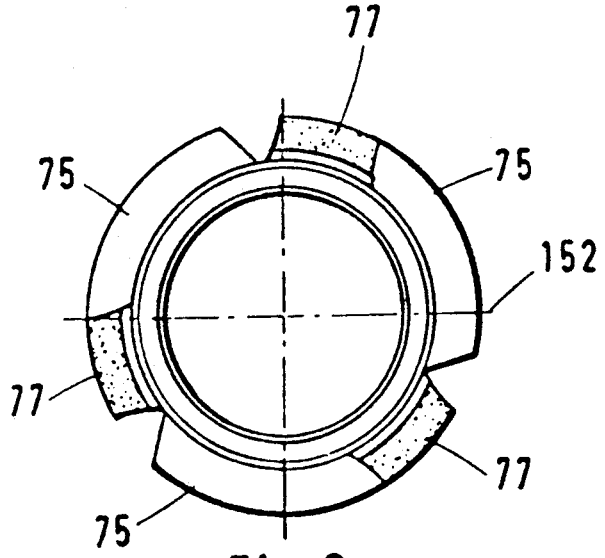
FIG. 6 shows an end view in the direction of arrow headed line B.

The casing mill shown in FIG. 4 has a tubular body 51 having a longitudinal axis 52. The body 51 has an upper portion 53 about the outer circumference of which are circumferentially disposed six milling blades 3 which are similar to the blades described with reference to FIGS. 1 and 2. The blades 3 may have a leading face, that is a forward face in the direction of rotation of the tool, on which is disposed tungsten carbide inserts which may be circular or square or rectangular, as disclosed in U.S. Pat. No. 4710074. Additionally, the blades 3 may be provided with a negative rake angle as known per se, although in the drawing of FIG. 4 the blades are shown having a zero rake angle. A lower, in use, part of the body 51 has a reduced diameter portion 54 leading to a portion having an external tapered screw thread 55. Adjacent the screw thread 55 is a relieved portion 56 and a lowermost, in use, end of the body 51 has a constant diameter portion 57 which locates inside the pilot stabiliser as will be described hereinafter. The body 51 has a circularly cross-sectioned bore (not shown in FIG. 4). The upper end of the body 51 has an internal screw thread for securing the body 51 to a drill string and the portion 57 at its lower internal end has a screw thread for securing other drill string elements thereto.

Figure 7:
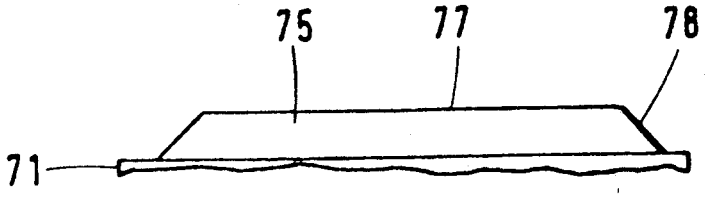
FIG. 7 shows a developed view of a fin shown in FIGS. 5 and 6.

Referring to FIGS. 5 to 8, the pilot stabiliser 70 has a tubular member 71 that has an internal bore 72 which is dimensioned to fit over the portion 57 such that the portion 57 assists to provide support for the pilot stabiliser 70. An upper, in use, end of the bore 72 is provided with a tapered, internal, screw thread 73 which is arranged to cooperate with the external tapered screw thread 55. The screw thread 73 extends upwardly to a counter bore 74 which is arranged to locate over a part of the portion 54. Three equi-circumferentially spaced fins 75 are located about the external surface of the member 71. The fins 75 are either integrally cast with the member 71 or are separate integers which are secured, for example, by welding to the body 71 and the fins helically extend about approximately 120° of the external surface of the member 71. A lower end 76 of each blade extends parallel to the longitudinal axis 152 of the body 71 which is common with the axis 52 of the body 51. The radially outer surface of each of the fins 75 is dressed with crushed tungsten carbide particles 77 so that the stabiliser 70 is also able to work as a taper mill to clean its way through the tubular member into which it is operated. As shown in FIG. 7 a lowermost end 78 of each fin 75 is tapered at an angle of approximately 45° to axis 152 and the crushed tungsten particles 77 are situated partway along the end 78 from the radially outer surface. The axial distance between the blades 3 and the fins 75 is preferably less than 25 cm to provide good mill stabilisation.

In operation, the stabiliser 70 is threadably secured to the casing mill of FIG. 4. By taking to a site a number of stabilisers of differing outside diameter so it is necessary only to have a single casing mill on site. It will be understood that the production of a number of stabilisers in cost terms is substantially less than the cost of making an equivalent number of integral tools as described in the prior art in relation to FIGS. 1 and 2 and the transportation cost thereof is also greatly reduced.

By this invention it is a simple and quick process to exchange one stabiliser for another on the casing mill so that the stabilisation outside diameter can be readily adjusted to suit changing well conditions.

It is envisaged that instead of there being a cooperating tapered screw thread between the milling tool and the stabiliser, the stabiliser may be secured to the milling tool by other means, such as for example, radial bolts.

Having described the invention with reference to a preferred embodiment, it is to be understood that changes may be made without departing from the spirit and scope of the invention as defined by the appended claims.

I claim:

1. A combination of a milling tool and a stabiliser therefor, said milling tool and said stabiliser both having a fixed outside diameter, said milling tool being adapted for milling tubular members and said stabiliser being adapted to stabilise said milling tool in said tubular member, said milling tool comprising a body having a longitudinal axis, a plurality of radially extending and circumferentially disposed blades about said body and means defining a lower portion of said body, said stabiliser being formed of a sleeve member having a continuous outside diameter and an axial internal bore located entirely around said body lower portion defining means, and releasable connection means for releasably connecting the stabiliser sleeve member to said milling tool lower portion defining means.

2. A combination as claimed in claim 1, wherein said releasable connection means is an external tapered screw thread provided on said body lower portion defining means and a cooperating internally tapered screw thread is provided in the internal bore of said stabiliser sleeve member.

3. A combination as claimed in claim 1, wherein said blades have narrow width in the circumferential direction in relation to the spacing between adjacent blades.

4. A combination as claimed in claim 1, wherein the stabiliser sleeve member has a plurality of fins equi-circumferentially spaced thereabout for contacting and providing stabilisation with the inner circumference of the tubular member to be milled.

5. A combination as claimed in claim 4, wherein the fins are helically disposed about said sleeve member.

6. A combination as claimed in claim 5, wherein fin extends about approximately 120° of said sleeve member.

7. A combination as claimed in claim 4, wherein an axially lower, in use, portion of each fin has a taper thereon.

8. A combination as claimed in claim 4, wherein each of the fins has a wear resistant material such as tungsten carbide provided on the radially outer part thereof.

9. A combination as claimed in claim 1, wherein the body lower portion defining means extends substantially all the way through the internal bore of the sleeve for providing additional support therefor.

10. A combination as claimed in claim 1, wherein the milling tool blades are provided with a wear resistant material on a leading face thereof which wear resistant material may be tungsten carbide inserts or crushed tungsten carbide particles randomly disposed in a bed of brazing alloy.

* * * * *